United States Patent [19]

Gullotti et al.

[11] 3,990,922

[45] Nov. 9, 1976

[54] PROCESSING ALUMINUM ALLOYS

[75] Inventors: Damian V. Gullotti, Cheshire; Philip R. Sperry, North Haven, both of Conn.; William C. Setzer, Creve Coeur, Mo.

[73] Assignee: Swiss Aluminium Ltd., Chippis, Switzerland

[22] Filed: Oct. 20, 1975

[21] Appl. No.: 623,677

[52] U.S. Cl. ..... 148/11.5 A; 148/12.7 A; 148/13

[51] Int. Cl.[2] ..... C22F 1/04

[58] Field of Search ..... 148/11.5 A, 12.7 A, 148/13

[56] References Cited

UNITED STATES PATENTS

| | | | |
|---|---|---|---|
| 3,379,583 | 4/1968 | Gruhl et al. | 148/11.5 A |
| 3,392,062 | 7/1968 | Altenpohl et al. | 148/11.5 A |
| 3,418,177 | 12/1968 | Pryor | 148/11.5 A |
| 3,762,962 | 10/1973 | Nilsson | 148/11.5 A |
| 3,816,190 | 6/1974 | Warbichler | 148/11.5 A |

*Primary Examiner*—W. Stallard

*Attorney, Agent, or Firm*—Robert H. Bachman; David A. Jackson; Robert A. Dawson

[57] ABSTRACT

A method of heat treating aluminum alloys of the aluminum magnesium-silicon type to improve processibility by extrusion which comprises initially homogenizing the alloys at an elevated temperature below the equilibrium solidus temperature of the alloy for from 2 to 12 hours, further homogenizing said alloys at an elevated temperature below the initial homogenization temperature and below the solvus temperature of the alloy for from 2 to 12 hours and slowly cooling said alloys to at least 800° F at a rate of less than 100° F per hour.

11 Claims, No Drawings

PROCESSING ALUMINUM ALLOYS

BACKGROUND OF THE INVENTION

The present invention relates to the art of making aluminum base alloy extruded products, and is particularly concerned with extruded products which receive a homogenization heat treatment prior to extrusion.

The metal working process known as extrusion involves pressing metal stock through a die opening of predetermined configuration in order to form a shape of indefinite length and substantially constant cross section. In the die extrusion process, with which this invention is concerned, the preheated aluminum base alloy stock is placed in a cylinder, usually heated, having a suitable die at one end and a reciprocable piston or ram of approximately the same cross sectional dimensions as the bore of the cylinder. The piston or ram moves against the stock to compress the stock and cause the metal to flow through the die opening. The pressure exerted on the stock during the operation raises the internal temperature of the stock as a result of internal friction within the metal body.

The present invention is particularly concerned with aluminum alloys of the aluminum-magnesium-silicon type. Extruded profiles of aluminum-magnesium-silicon alloys have considerable commercial value. When heat hardened, such profiles have desirably high strength characteristics. In order to produce such profiles in the most economical manner extrusion should be carried out at the highest speed possible. Conventionally, the extrudability of these alloys is improved by subjecting the cast ingot to an elevated temperature homogenizing process, such as at 955° – 1025° F for from 4 to 12 hours followed by air cooling. It is naturally highly desirable to provide a process for economically improving extrusion speed while maintaining desirable product characteristics.

However, extrusion speed is a factor which affects the quality of an extruded product. In order to achieve acceptable surface quality a certain range of extrusion speeds must be observed, with the range being related to the extrusion size and the reduction in cross sectional area effected by the extrusion. Exceeding the predetermined speed generally causes a rupture of the surface and also other defects which result in rejection of the product.

A limiting factor for extrusion of an aluminum alloy is the onset at some extrusion rate of the phenomenon known as surface checking or chatter cracks. These are surface defects which form a pattern of fine transverse cracks resulting from longitudinal tensile stresses which are high compared with the strength of the alloy at its working temperature. Incipient cracks may be no deeper than 0.001 to 0.005 inch; however, they are unacceptable from the standpoint of surface appearance, finishing ability, dimensional accuracy and mechanical integrity. It is known that the surface checking phenomenon occurs at lower speeds as the extrusion temperature is raised. In addition, high strength alloys must be extruded more slowly and at lower temperatures in order to avoid cracking. This suggests that there is a relationship between flow stresses and cracking tendency due to rises in extrusion surface temperature caused by adiabatic heating.

SUMMARY OF THE INVENTION

The present invention comprises a method of heat treating aluminum alloys of the aluminum-magnesium-silicon type in order to improve processibility by extrusion. The method comprises:

A. initially homogenizing said alloys at a temperature of from 1035° to 1125° F for from 2 to 12 hours, provided that the upper temperature is maintained below the equilibrium solidus temperature;

B. further homogenizing said alloys at a temperature of from 20° to 100° F below the solvus temperature for from 2 to 12 hours; and C. slowly cooling said alloys to at least 800° F at a rate of less than 100° F per hour.

Following the slow cooling step, the material is cooled to room temperature and reheated to an elevated temperature for extrusion at said elevated temperature. Preferably, the extruded product is then quenched and aged at a temperature from 300° to 450° F for from 1 to 24 hours.

Accordingly, it is a principal object of the present invention to provide a method of heat treating aluminum alloys of the aluminum-magnesium-silicon type to improve processibility by extrusion.

It is a particular object of the present invention to provide a method as aforesaid which enables an increase in extrusion speed.

It is a still further object of the present invention to provide a method as aforesaid which results in an extruded product having good mechanical properties and freedom from surface cracks.

Further objects and advantages of the present invention will appear hereinbelow.

DETAILED DESCRIPTION OF PREFERRED EMBODIMENTS

The aluminum-magnesium-silicon alloys processed in accordance with the present invention contain magnesium-silicide and, preferably, contain about 0.6 to 2% of the intermetallic compound magnesium-silicide ($Mg_2Si$) as the primary strengthening component. The alloy may contain an excess of magnesium or silicon. Generally the alloys processed in accordance with the present invention should contain 0.2 to 1.5% magnesium and from 0.2 to 1.5% silicon. As used in the present specification, all percentages of ingredients are percentages by weight.

Preferably, the alloys processed in accordance with the present invention are those of the 6000 series of the Aluminum Association classification system, of which Alloy 6061 is preferred. For example, a typical preferred composition is Alloy 6061 as follows:

| | | |
|---|---|---|
| Silicon | — | 0.40 to 0.8% |
| Magnesium | — | 0.8 to 1.2% |
| Copper | — | 0.15 to 0.40% |
| Chromium | — | 0.04 to 0.35% |
| Iron | — | Up to 0.7% |
| Manganese | — | Up to 0.15% |
| Zinc | — | Up to 0.25% |
| Titanium | — | Up to 0.15% |
| Others Total | — | Up to 0.15% |
| Each | — | Up to 0.05% |
| Aluminum | — | Balance |

Further preferred materials processed in accordance with the present invention are Alloys 6007, 6070, 6205 and 6351.

In the preferred embodiment, the alloys processed in accordance with the present invention contain one or more of the following elements: boron, titanium, chromium, manganese, molybdenum, vanadium, tungsten and zirconium in an amount up to 0.40%; however, with the exception of the boron which should be used in an amount up to 0.10%. The total amount of the foregoing elements should not exceed 1%. Naturally, amounts as low as 0.001% may be found in the alloys.

The usual impurities may also be present. Iron is preferably tolerated in an amount up to 1%, copper in an amount up to 0.5% and zinc in an amount up to 0.5%, with as low as 0.001% iron, copper and/or zinc being contemplated.

Hot workability, in general, may be improved by lowering the flow stress at the extrusion temperature. This allows an alloy to be deformed at a higher rate without as much adiabatic heating as would be the case if the flow stress were higher. Variations in homogenization practice for as-cast billets offer an attractive means whereby the flow strength of an alloy can be altered. Thus, the first function of a homogenization treatment prior to extrusion is to minimize chemical gradients and microsegregation of alloying constituents in the ingot which result from casting. The second function is to place the alloy in a condition in which it can be more readily worked. Longer homogenization times are effective in materially decreasing flow stresses upon subsequent hot working by promoting precipitation from the solid solution of impurity or minor alloying elements which are normally slow to precipitate, such as iron, chromium and manganese. In addition, the state of solute content and particulate dispersion at the end of a homogenization holding cycle can be further improved by controlling the cooling conditions within the limits allowable for achieving desired final properties and characteristics.

It has been found in accordance with the present invention that bulk flow stress can be reduced by creating the minimum degree of both solid solution hardening and dispersion hardening at the extrusion temperature. This has been obtained in a homogenized microstructure which consists of predominately large particle dispersions of magnesiumsilicide and at the same time having as much iron, chromium and manganese as possible taken out of solution.

The ingots themselves may be produced by any of the well known casting processes, the continuous or semi-continuous method being one of the most commonly used at present. The processing of the present invention was devised in order to achieve the foregoing objectives using a duplex homogenization cycle prior to extrusion. Thus, in accordance with the present invention the initial homogenization treatment is at a temperature of from 1035° to 1125° F, preferably from 1035° to 1080° F, for from 2 to 12 hours, preferably 4 to 10 hours, with the proviso that the upper temperature is maintained below the equilibrium solidus temperature. For example, the equilibrium solidus temperature of Alloy 6061 is 1080° F. The process of the present invention is particularly appropriate for alloys such as Alloy 6061 which have deliberate additions of chromium, manganese and/or other transition elements with limited solid solubility so that the holding treatment of the present invention drives these additions out of solution; whereas, less improvement is obtained with alloys such as Alloy 6063 without deliberate transition element additions.

The further homogenization step is at a temperature of from 20° to 100° F below the solvus temperature, as determined by the particular magnesium-silicon content of the alloy in question, for from 2 to 12 hours and preferably from 4 to 10 hours. For example, the solvus temperature of Alloy 6061 is 1020° F, therefore, the second or further holding step should be from 920° –1000° F for Alloy 6061. Preferably, the further holding step should be from 20° to 50° F below the solvus temperature. Following the further homogenization step the alloys are slowly cooled to at least 800° F at a rate of less than 100° F per hour, and preferably at a rate of less than 50° F per hour, followed by cooling to room temperature at any desired rate, preferably air cooling.

The first stage of the homogenization treatment, the initial homogenization stage, serves to precipitate from solid solution the normally slow diffusing phases, as the iron, chromium and manganese phases. This would tend to lower the matrix strength by removing these elements from any active hardening role and by causing precipitate particles to become relatively large; however, at the temperature of the initial homogenization treatment substantially all magnesium and silicon are soluble and can stay in solution with moderately fast cooling. The second stage or further homogenization treatment at a lower temperature, followed by the slow cooling step to 800° F or lower, further reduces the iron, chromium and manganese solute content and also results in the attainment of a dispersion of predominantely large $Mg_2Si$ particles. The second homogenization treatment precipitates $Mg_2Si$ and causes large particles to grow which only occurs below the solvus temperature. Holding too far below the solvus temperature would promote the formation of fine $Mg_2Si$ particles. Also, the slow cooling to at least 800° F further coarsens the $Mg_2Si$ particles.

After cooling to substantially room temperature, the material is reheated to an elevated temperature and extruded at said elevated temperature. Normally, the material is reheated to a temperature of 800° to 1025° F, with an extrusion entry temperature of from about 800° to 900° F and an extrusion exit temperature of from about 920° to 1020° F. The time at reheat or preheat temperature prior to extrusion should be less than about 15 minutes. Upon this subsequent reheating and extrusion in this common temperature range, the $Mg_2Si$ will redissolve only to such an extent that will assure suitable strength in the finished extruded product as quenched and aged. The combination of residual $Mg_2Si$ particles and the precipitated iron, chromium and manganese rich phases result in a more readily workable material which will offer lower resistance to deformation during extrusion and allow the attainment of higher extrusion speeds. As a comparison, the normal homogenization treatment of 955° to 1025° F for from 4 to 12 hours, or even for 16 hours, followed by air cooling, will produce fine or mixed dispersions of $Mg_2Si$ and minimal precipitation and agglomeration of the iron, chromium and manganese containing constituents. Upon preheating for extrusion, the fine $Mg_2Si$ that precipitated upon cooling after the usual homogenization treatment will rapidly redissolve and add to hardening of the solid solution matrix caused by retention of iron, chromium and manganese solutes. Thus, during extrusion, the metal will offer considerable resistance to deformation (i.e., a higher flow stress) in contrast to metal treated in accordance with the process of the present invention.

Following extrusion as aforesaid the extruded product is quenched and aged at a temperature of from 300° to 450° F for from 1 to 24 hours. The quenching medium may naturally be moving air, complete water immersion, water sprays or combinations thereof.

Thus, in accordance with the process of the present invention a careful control of processing conditions is required in order to reduce the flow stress during extrusion and subsequently increase the rate at which extrusions can be pushed through the extrusion die. The initial or high temperature homogenization step is important in assisting in precipitation of elements, such as manganese, chromium or iron. This high temperature step is also beneficial in that when precipitation occurs the particles tend to coalesce and be widely spaced. Secondly, by the further or lower temperature homogenization step and holding at this lower temperature for the required period of time, the $Mg_2Si$ which precipitates also tends to be distributed as widely spaced coarse particles, thereby minimizing a potential dispersion hardening effect. Slow cooling to 800° F or below causes these particles to grow so that upon subsequent reheating to extrusion temperature there is a lag in time before all of the soluble $Mg_2Si$ goes into solution.

The present invention and improvements effected thereby will be more apparent from a consideration of the following illustrative examples.

EXAMPLE I

Aluminum Alloy 6061 was cast in a conventional manner by direct chill casting to have the following composition:

| | | |
|---|---|---|
| Magnesium | — | 1% |
| Silicon | — | .7% |
| Chromium | — | .04% |
| Manganese | — | .1% |
| Iron | — | .45% |
| Titanium | — | .02% |
| Zinc | — | .03% |
| Copper | — | .20% |
| Aluminum | — | Balance |

EXAMPLE II

A variety of the ingots prepared in accordance with Example I were processed in order to evaluate flow stress and extrusion speed for two different homogenization conditions by systematically increasing extrusion speed until surface checking occurred. Homogenization treatment A consisted of heating at 1025° F for 16 hours followed by air cooling. Homogenization treatment B of the present invention consisted of heating at a temperature of 1050° F for 8 hours, followed by 8 hours at 1000° F followed by cooling to 800° F at a rate of 50° F per hour and air cooling to room temperature. The extrusion procedure utilized an extrusion ratio of 68.5:1. The billets were preheated to 960° to 980° F, with the billets allowed to cool and enter the extrusion press at a temperature 900° to 950° F. The ram speed was gradually stepped up as maximum pressure drops until the maximum ram speed is obtained on each run. A summary of the data obtained in accordance with the experiment is shown in Table I below, which shows entry temperature, extrusion exit temperatures and ram speeds for each billet. In addition, the surface condition of each extrusion was noted. There are five loctions on this particular extrusion where cracking can initiate. An evaluation of cracking severity was made and appears in Table I as good, which indicates substantially no cracking, or bad, which indicates significant cracking. The data shown in Table I clearly illustrates the superiority of the duplex homogenization treatment of the present invention which allows the extrusion speed to be raised significantly. With comparative homogenization treatment A, the extrusion in question cannot be safely extruded at more than 7.5 inches per minute (ipm). Using the homogenization treatment B of the present invention, the extrusion speed can be raised to 13 ipm.

TABLE I

| Homogenization Treatment | Billet Entry Temp., ° F | Extrusion Exit Temp. ° F | Ram Speed, ipm | Surface Condition |
|---|---|---|---|---|
| A — Test No. 1 | 917 | 1020 | 7.5 | Good |
| A — Test No. 2 | 910 | 1000 | 10 | Bad |
| A — Test No. 3 | 947 | 1020 | 7.8–10 | Bad |
| A — Test No. 4 | 1020 | — | 10 | Bad |
| B — Test No. 5 | 950 | 1010 | 5–8 | Good |
| B — Test No. 6 | 920 | 1020 | 10–12 | Good |
| B — Test No. 7 | 910 | 1020 | 10 | Good |
| B — Test No. 8 | 910 | 1020 | 14 | Bad |
| B — Test No. 9 | 917 | 1040 | 12 | Good |
| B — Test No. 10 | — | 1020 | 12 | Good |
| B — Test No. 11 | 845 | 1000 | 13 | Good |

EXAMPLE III

Tensile samples were taken from some extrusions obtained in accordance with experiment two. The samples were aged for 8 hours at 350° F and mechanical properties are listed in Table II. These mechanical properties clearly show that the extrusion procedure of the present invention exceeds the strength requirements for Alloy 6061 - T6 temper and results in good strength properties.

TABLE II

| Homogenization Treatment | Ram Speed | Yield Strength ksi | Ultimate Tensile Strength ksi | Elongation in 2" % |
|---|---|---|---|---|
| A — Test No. 1 | 7.5 | 38.7 | 43.0 | 12.0 |
| A — Test No. 3 | 10 | 41.6 | 45.8 | 12.5 |
| B — Test No. 5 | 8 | 37.7 | 42.4 | 12.5 |
| B — Test No. 8 | 14 | 39.0 | 43.6 | 12.5 |
| B — Test No. 9 | 12 | 38.1 | 42.7 | 12.5 |
| B — Test No. 11 | 13 | 36.5 | 40.2 | 12.5 |

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method of heat treating aluminum alloys of the aluminum-magnesium-silicon type to improve processibility by extrusion which comprises:

A. initially homogenizing said alloys at a temperature of from 1035° to 1125° F for from 2 to 12 hours provided that the temperture is maintained below the equilibrium solidus temperature;

B. further homogenizing said alloys at a temperature of from 20° to 100° F below the solvus temperature for from 2 to 12 hours; and C. slowly cooling said alloys to at least 800° F at a rate of less than 100° F per hour.

2. The method of claim 1 wherein said initial homogenization is at a temperature of 1035° to 1080° F for from 4 to 10 hours, said further homogenization is at a temperature of from 20° to 50° F below the solvus temperature for from 4 to 10 hours and said slow cooling is at a rate of less than 50° F per hour.

3. The method of claim 1 wherein said material is cooled to room temperature following said slow cooling step.

4. The method of claim 3 wherein the material is reheated to an elevated temperature after being cooled to room temperature and extruded at said elevated temperature.

5. The method of claim 4 wherein the material is reheated to a temperature of from 800° to 1025° F and held at said temperature for less than 15 minutes prior to extrusion.

6. The method of claim 5 wherein the extrusion entry temperature is from 800° to 900° F and the extrusion exit temperature is from 920° to 1020° F.

7. The method of claim 4 wherein following said extrusion step the material is quenched and aged at a temperature of from 300° to 450° F for from 1 to 24 hours.

8. The method of claim 1 wherein said alloy contains from 0.2 to 1.5% magnesium and from 0.2 to 1.5% silicon.

9. The method of claim 8 wherein said alloy contains from 0.001 to 0.4% of a material selected from the group consisting of boron, titanium, chromium, manganese, molybdenum, vanadium, tungsten, zirconium and mixtures thereof, with the boron being present in an amount up to 0.1%.

10. The method of claim 9 wherein said alloy contains a material selected from the group consisting of from 0.001 to 1.0% iron, from 0.001 to 0.5% copper, from 0.001 to 0.5% zinc and mixtures thereof.

11. The method of claim 1 wherein said alloy is aluminum alloy 6061 and wherein said initial homogenization temperature is from 1035° to 1080° F and said further homogenization is from 920° to 1000° F.

* * * * *